United States Patent [19]

Petersen et al.

[11] 4,439,119

[45] Mar. 27, 1984

[54] GEROTOR MACHINE WITH COMMUTATING VALVING THROUGH THE RING GEAR

[75] Inventors: Hans C. Petersen; Søren N. Sørensen, both of Nordborg, Denmark

[73] Assignee: Danfoss A/S, Nordborg, Denmark

[21] Appl. No.: 418,431

[22] Filed: Sep. 15, 1982

Related U.S. Application Data

[63] Continuation of Ser. No. 177,373, Aug. 12, 1980, abandoned.

[30] Foreign Application Priority Data

Aug. 13, 1979 [DE] Fed. Rep. of Germany ..... 2932728

[51] Int. Cl.[3] ..... F01C 1/10; F01C 21/00

[52] U.S. Cl. ..... 418/61 B; 418/75; 418/186

[58] Field of Search ..... 418/77, 79, 81, 61 B, 418/186–188, 75

[56] References Cited

U.S. PATENT DOCUMENTS

| | | | |
|---|---|---|---|
| 3,512,905 | 5/1970 | Waldorff | 418/61 B |
| 3,778,197 | 12/1973 | Takagi | 418/61 B |
| 3,846,051 | 11/1974 | McDermott | 418/61 B |
| 3,905,727 | 9/1975 | Kilmer | 418/61 B |
| 3,989,951 | 6/1961 | Charlson | 418/61 B |

FOREIGN PATENT DOCUMENTS

| | | | |
|---|---|---|---|
| 1811386 | 6/1970 | Fed. Rep. of Germany | 418/61 B |
| 53-16145 | 2/1978 | Japan | 418/61 B |

*Primary Examiner*—John J. Vrablik

*Attorney, Agent, or Firm*—Wayne B. Easton

[57] ABSTRACT

The invention relates to a fluid pressure operated motor or pump of the type having a gerotor displacement mechanism which normally includes inner and outer wheel and ring gears which in operation have relative rotational and orbital movement therebetween. Such devices inherently have a form of valving wherein, with a commutating type of action, fluid is directed from the casing inlet to expanding chambers of the gerotor and directed from collapsing gerotor chambers to the casing outlet. Two embodiments are presented in which the first has the casing thereof fixed in space. In both units the commutator valving includes valving patterns in two valve plates attached to opposite sides of the casing and in the wheel gear which has orbital movement relative to the casing. The commutating valving arrangement has control ports on opposite sides of the unit for feeding and exhausting motive fluid to and from the unit and auxiliary ports on opposite sides of the unit to balance or equalize the pressure forces on each side thereof. Bolts are used for fastening the tightening together the casing side plates. These bolts are also used as guides for the orbital path of the ring gear and holes are provided in the ring gear to accommodate the bolts.

6 Claims, 5 Drawing Figures

GEROTOR MACHINE WITH COMMUTATING VALVING THROUGH THE RING GEAR

Figure 1:
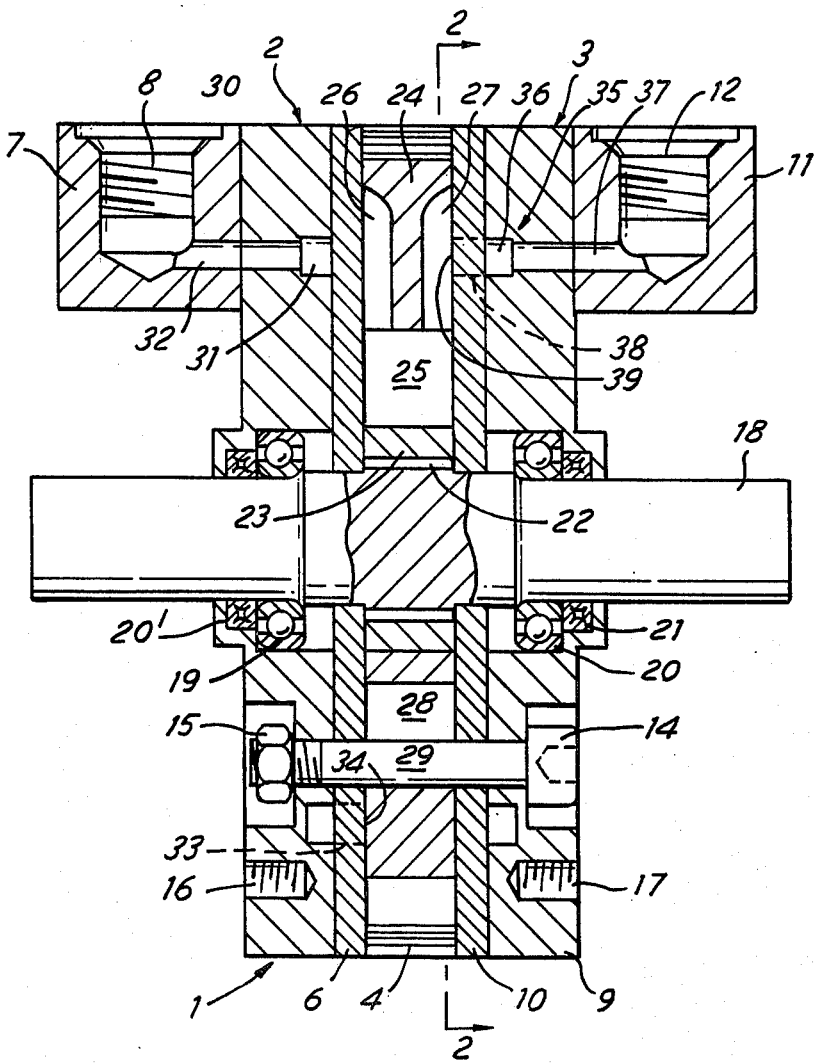

This is a continuation of application Ser. No. 177,373, filed Aug. 12, 1980, now abandoned.

The invention relates to a hydraulic machine, having a casing, an externally toothed gear wheel coupled with an axle, and a surrounding gear ring meshing therewith and forming displacement chambers, of which the casing and gear wheel rotate relatively to each other and the surrounding gear ring moves on a circular orbit with respect to both, the casing comprising two side members separated by an outer spacing ring and held together by axial tightening screws, as well as two distributor channel systems, each connected with a pressure fluid inlet, the distributor channels thereof leading to first and second control apertures on the face toward the gear ring each associated with a displacement chamber, and the gear ring comprising circular cutouts traversed by a cylindrical guide element and radial channels between pairs of teeth which in the circular orbit movement shift the control apertures in such a way that each displacement chamber enters into communication alternately with its first and with its second control aperture.

In a known hydraulic machine of this kind, the tightening screws pass through the outer spacing ring. The latter, therefore, must have a corresponding radial thickness. Both distributor channel systems are arranged with the respective control apertures in a side member. They comprise two concentric annular channels, of which one is located inside and the other outside that radius on which the first and second control apertures lie. Because of this arrangement of the annular channels and because of the thickness of the spacing ring there results a minimum diameter for the hydraulic machine. The last-named side member consists of two plates, one of which has axial channels which at one end form the control aperture and at the other end are connected via a radial groove to the annular channel, here formed as an annular groove covered by the second plate. The other side member consists of a plate. The rotatable axle is mounted in rolling bearings in both side members. The cylindrical guide element has eccentric pivot pins, also mounted in the side members.

It is the object of the invention to provide a hydraulic machine of the above described kind which, under otherwise equal conditions, can be given a smaller diameter.

According to the invention, this problem is solved in that the tightening screws pass through the circular cutouts and with a cylinder section concentric to the screw axis form the guide element, and that the distributor channel systems end approximately on the same circular circumference and are each arranged in a side member.

In this design, the tightening screws are moved radially inward. Therefore, a radially thinner spacing ring can be used. It was found, surprisingly, that it is not necessary to guide the gear ring by means of eccentric guide elements, but that it suffices if the circular cutouts are contiguous to cylindrical guide elements of smaller diameter. Due to the fact that both side members each receive a distributor channel system, the required outside diameter can be reduced accordingly. Both measures lead to the desired diameter reduction of the hydraulic machine.

Conveniently, for a stationary casing, the connections are lodged in blocks attached to the edge of the casing and extend approximately radially. By these connections also the diameter of the machine is not increased.

For a stationary gear wheel, conveniently the fixed axle has a connection at each of the two ends, which leads to the respective distributor channel system via an axial channel. Thereby also the outside diameter is not adversely affected.

In a preferred embodiment provision is made that the distributor channel systems, each having an annular channel and axis-parallel distributor channels connected therewith, are formed identically. Both distributor channel systems, therefore, have the same outside diameter. They permit a completely symmetrical construction of the hydraulic machine, it being possible to use identical components on both sides of the gear wheel, thereby making a rationalization of the manufacturing process possible.

In particular, each side member can have a distributor plate with axis-parallel distributor channels and a relatively thicker end wall comprising the rest of the distributor channel system as grooves. The distributor plate, since comprises only the axis-parallel distributor channels, can then be made very thin.

In one form of realization, each annular channel is arranged at the level of the control apertures and connected via an axial channel with the adjacent connection. This results in a very simple channel layout.

In another alternative, each annular channel is bounded by the axle, is connected via at least one radial channel with the axial channel of the axle, and leads via radial grooves to the axis-parallel distributor channels. This solution is favorable if the connections are disposed at the ends of the axle.

In further development of the invention provision is made that opposite each control aperture an auxiliary aperture of the same size is provided in the other side member, and that the auxiliary apertures of each side member are connected with one another via a compensation channel system. Thus the gear ring is loaded uniformly on both sides, thereby avoiding tilting and unilateral wear by friction.

In particular, each compensation channel system may alternatively be formed as a power takeoff device, e.g. a pulley. The circumference of such a hydraulic engine can then be used directly for the power takeoff.

Figure 2:
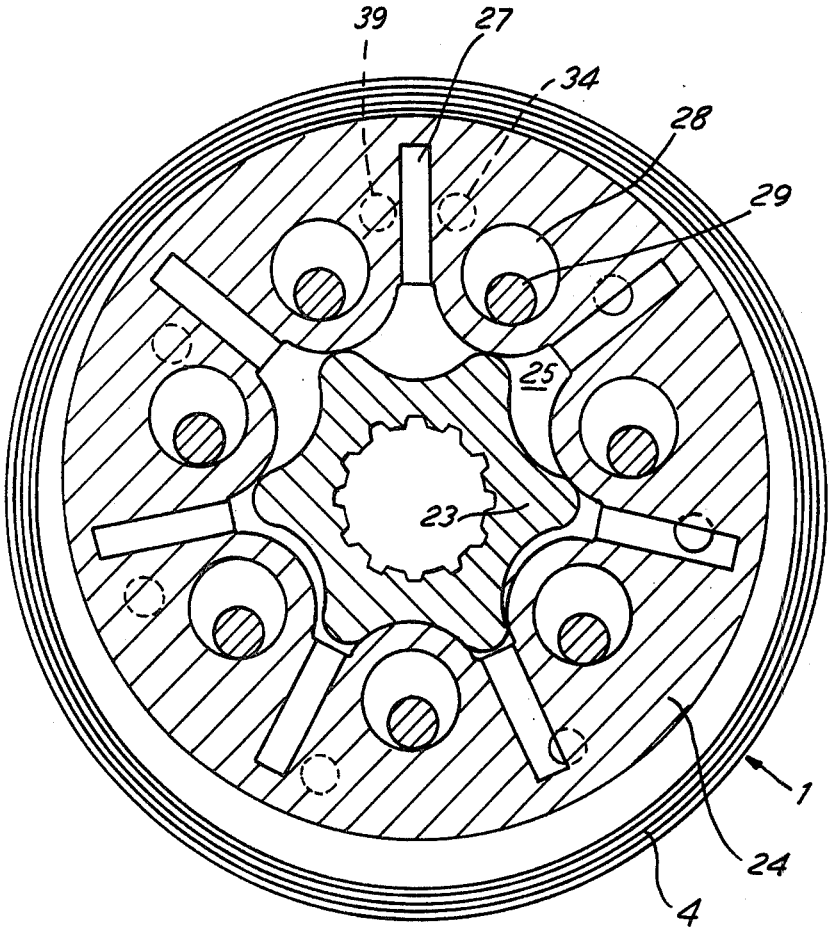
Figure 3:
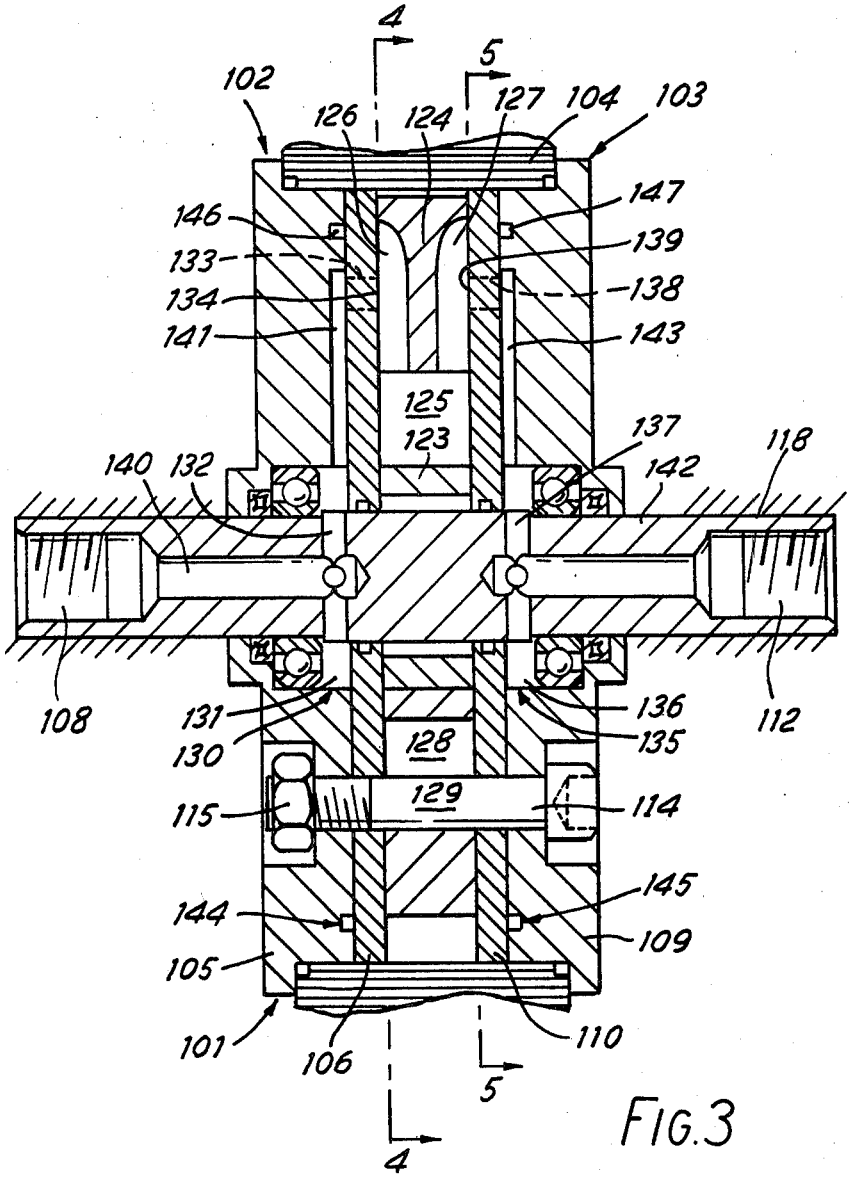
Figure 4:
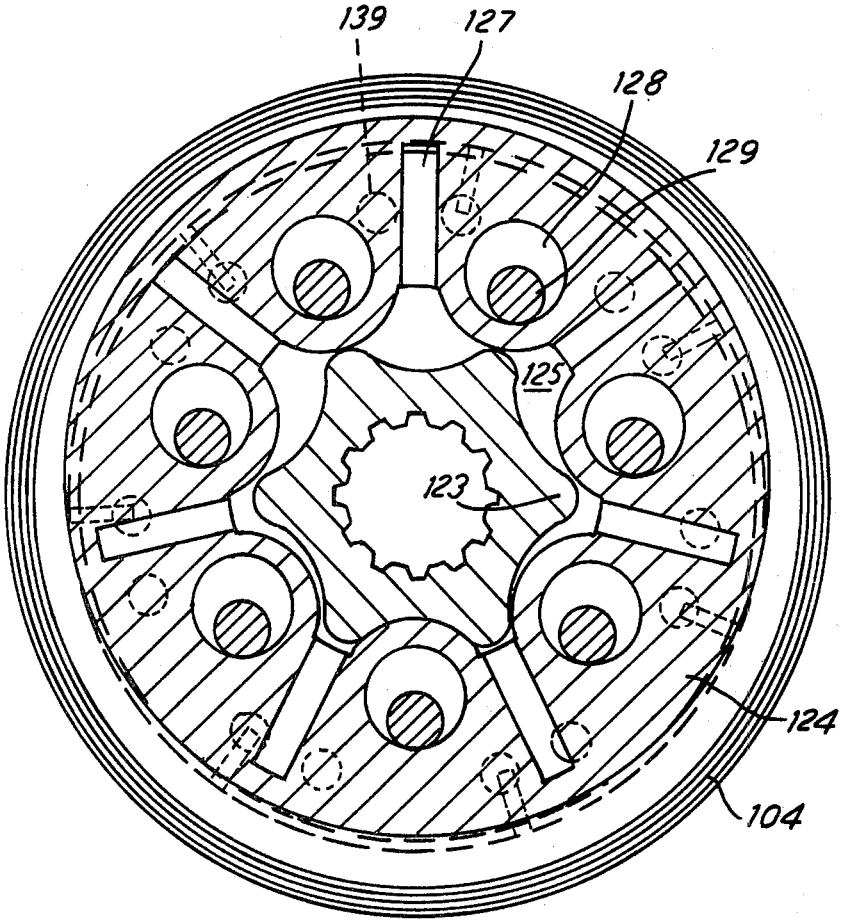

The invention will be explained below in greater detail with reference to preferred embodiments illustrated in the drawing, in which:

FIG. 1 shows a longitudinal section through a hydraulic engine according to the invention with fixed casing;

FIG. 2, a transverse section along line 2—2 of FIG. 1;

FIG. 3, a longitudinal section through a hydraulic engine according to the invention with fixed axle;

FIG. 4, a transverse section along line 4—4 of FIG. 3; and

Figure 5:
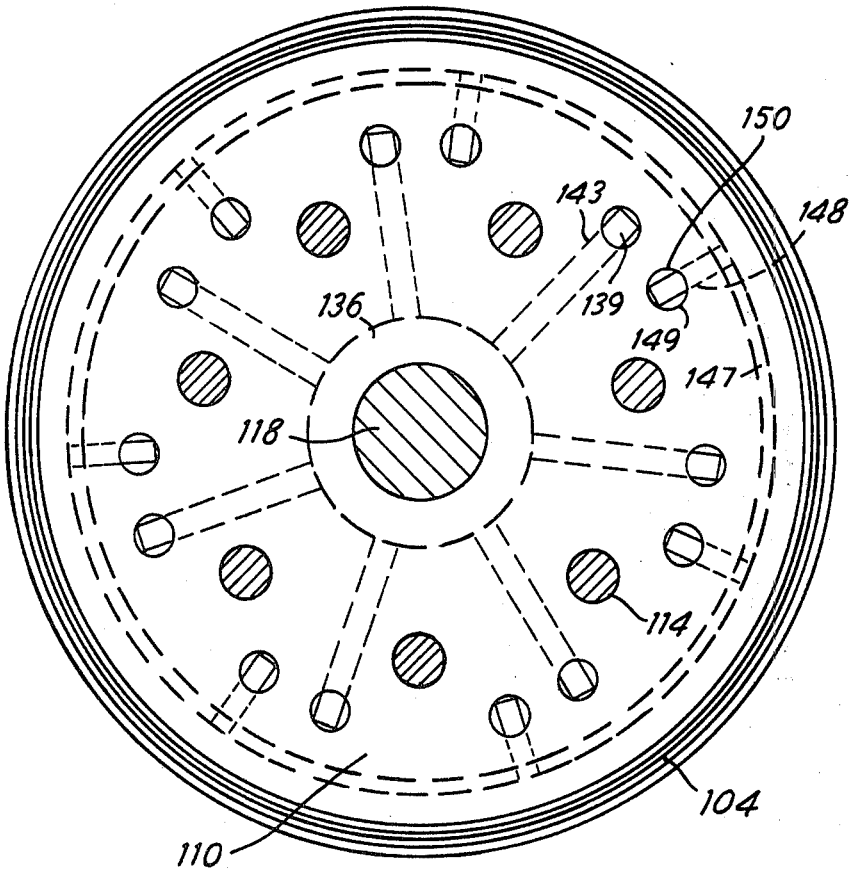

FIG. 5, a transverse section along line 5—5 of FIG. 3.

In FIG. 1 a hydraulic engine is shown, whose casing 1 consists of two side members 2 and 3 as well as an interposed spacing ring 4. Side member 1 comprises an end wall 5, a distributor plate 6, and on the outer edge thereof a block 7 with a first connection 8. Side member 3 comprises an end wall 9, a distributor plate 10, and on the outer edge a block 11 with a second connection 12. The side members are held together by tightening screws 14 with nuts 15. On the casing are threaded parts 16 and 17, by means of which a fixed installation can be made.

A rotatable output shaft or axle 18, which is mounted in each side member by means of a ball bearing 19, 20 and is sealed to the outside by a seal ring 20', 21 carries on a serration 22 an externally toothed gear ring 23, which accordingly rotates with the axle 18. It is surrounded by an internally toothed gear ring 24, in such a way that displacement chambers 25 form. From each displacement chamber two radial grooves 26 and 27, which begin between the teeth of the gear ring, go outward. In addition, the gear ring has circular cutouts 28, which are traversed by the tightening screws 14. Cylindrical sections 29 of the tightening screws form a guide element, which applies against the circumference of the respective cutout 28.

A first distributor channel system 30 in side member 2 consists of an annular channel 31, which is connected via an axial channel 32 with the connection 8, and of axis-parallel channels 33 in the distributor plate 6 which by their mouths form first control apertures 34.

A second distributor channel system 35 consists of an annular channel 36, which is connected via an axial channel 37 with the connection 12, and of axis-parallel distributor channels 38 whose mouths form second control apertures 39. The position of the second control apertures 39 can be seen from FIG. 2. The dash-dot lines represent the projection of a first control aperture 34.

The distributor plates 6 and 10, the end walls 5 and 9, and the blocks 7 and 11 are pairs of identical parts, which can be manufactured in a rational manner. In particular they may be made of sintered material. Also the gear wheel 23 and gear ring 24 may be sintered.

When pressure fluid is supplied via the connection 8, it passes via axial channel 32, annular channel 31 and the axis-parallel distributor channels 33 to the first control apertures 34. The latter communicate with the displacement chambers 25 to the left of the vertical median line in FIG. 2. The displacement chambers 25 to the right of the median line are connected via the second control apertures 39, the axis-parallel distributor channels 38, the annular channel 36 and the axial channel 37 with the connection 12 which leads to the tank. Consequently the gear ring 23 and hence the axle 18 rotate clockwise in FIG. 2. At the same time gear ring 24 executes a guided circular orbit movement, which is determined by application of the circular cutouts 28 against the cylinder sections 29. Due to this circular orbit movement, the covering of the control apertures by the radial grooves 26 and 27 changes, so that the displacement chambers are switched successively.

In the form of realization according to FIGS. 3 to 5, reference symbols increased by 100 with respect to FIGS. 1 and 2 are used for similar parts. In this case the axle 118 is disposed fast to the casing. Accordingly, casing 101 rotates. The spacing ring 104 is designed as a pulley, so that the casing serves directly as power takeoff device. The first distributor channel system 130 comprises an annular channel 131, which is connected with the connection 108 via radial channels 132 and an axial channel 140, and also comprises radial grooves 141 and axis-parallel channels 133 leading to the first control apertures 134. The second channel system 135 comprises an annular channel 136, which is connected with the connection 112 via radial channels 137 and an axial channel 142, and also comprises radial grooves 143 and axis-parallel channels 138 leading to the second control apertures 139. These control apertures 134 and 139 have a similar position as shown in FIG. 2.

In addition, each side member comprises a compensation channel system 144, 145. Of the left system only an annular groove 146 can be seen in FIG. 3. But the system is laid out exactly as the one on the right side, which besides the annular groove 147 likewise comprises inwardly directed radial grooves 148 extending in the end wall 109 and axis-parallel compensation channels 149 passing through the distributor plate 110 and leading to auxiliary apertures 150. The auxiliary apertures 150 are exactly opposite the first control apertures 134, and the auxiliary apertures of the other compensation channel system 144 are exactly opposite the second control apertures 139.

When pressure fluid is supplied via connection 108, the casing now rotates counterclockwise in FIGS. 4 and 5, because the gear ring is displaced relative to the fixed gear wheel, taking the casing 101 along. Since auxiliary apertures 150 always communicate with the radial groove 127 when the radial groove 126 is connected with the first control aperture 134, the feed pressure prevails in the compensation channel system 145. Conversely, in the other compensation channel system 144 the outflow pressure prevails. Consequently exactly the same pressure prevails opposite the closed first and second control apertures at the corresponding auxiliary apertures, so that gear ring 124 is loaded exactly symmetrically. Consequently there results no jamming and no unnecessary friction. Also the axle 118 can be made with a comparatively small diameter. Expediently it is designed symmetrical to both sides.

The hydraulic machines can also be operated as pumps. Instead of the pulley 4, a V-notched pulley, a gear or the like can serve as power takeoff device.

What is claimed:

1. A rotary piston machine, comprising, a fixed shaft member, a casing surrounding said shaft member and mounted in sealing and rotatable relation to said shaft member, said shaft member having fluid inlet and outlet passages, radially inner and outer gerotor type wheel and ring gears having rotatable and orbital movement relative to each other and being operable to form expansible chambers therebetween, the orbital movement of said wheel gear relative to said ring gear causing the line of eccentricity therebetween to rotate relative to the axis of said ring gear, said wheel gear being fixedly attached to said shaft member, said ring gear having rotatable movement relative to said shaft member and being connected to said casing so as to only have orbital movement relative thereto, said ring gear having generally radially extending first and second sets of commutating valving slots formed on opposite sides thereof, said casing forming first and second axially spaced sidewalls engaging opposite sides of said gears in sealing engagement therewith, said first and second casing sidewalls having first and second sets of commutating valving control apertures fluidly connected respectively to said inlet and outlet passages and being respectively cooperable with said first and second sets of ring gear valving slots so that when there is relative movement between said wheel and ring gears said expansible chambers on opposite sides of said line of eccentricity have constant fluid communication respectively with said inlet and outlet passages (.), said first and second sidewalls including first and second commutating valving auxiliary apertures respectively cooperable with said first and second sets of gear valving slots to provide hydraulic balancing for opposite sides of said wheel and ring gears, said first set of auxiliary apertures in said first sidewall being exactly opposite said sidewall second set of control apertures in said second sidewall and said second set of auxiliary apertures in said second sidewall being exactly opposite said first set of control apertures in said first sidewall.

2. A rotary piston machine according to claim 1 including first and second annular channels between said casing and said shaft member having respective fluid communication with said shaft member inlet and outlet passages and said casing first and second sets of valving apertures.

3. A rotary piston machine according to claim 1 wherein said first and second sets of auxiliary apertures are on the same respective sides of said casing as said first and second sets of control apertures.

4. A rotary piston machine according to claim 1 wherein said sidewalls have first and second annular passages located radially beyond said auxiliary apertures and have respective fluid communication with said first and second auxiliary apertures.

5. A rotary piston machine according to claim 1 including guide means for controlling said orbital movement of said ring gear relative to said casing member.

6. A rotary piston machine according to claim 5 wherein said guide means include at least one transversely extending hole in said ring gear and rod means extending transversely between said casing sidewalls and through said ring gear hole.

* * * * *